US005597495A

United States Patent [19]

Keil et al.

[11] Patent Number: 5,597,495

[45] Date of Patent: Jan. 28, 1997

[54] METHOD AND APPARATUS FOR ETCHING SURFACES WITH ATOMIC FLUORINE

[76] Inventors: Mark Keil, 801 Nancy Lynn Ter., Norman, Okla. 73069; Joel H. Young, 7510 E. Lindsey, Norman, Okla. 73071; Kyle Copeland, 609 Stinson, Apt. B, Norman, Okla. 73072

[21] Appl. No.: 335,564

[22] Filed: Nov. 7, 1994

[51] Int. Cl.[6] ..... B44C 1/22

[52] U.S. Cl. ..... 216/66; 216/58; 156/646.1; 156/345; 156/643.1

[58] Field of Search ..... 156/643.1, 646.1, 156/654.1, 655.1, 345, 345 P; 216/66, 67; 204/192.34, 298.36

[56] References Cited

U.S. PATENT DOCUMENTS

| | | | |
|---|---|---|---|
| 4,734,152 | 3/1988 | Geis et al. | 156/646 |
| 4,874,459 | 10/1989 | Coldren et al | 156/646.1 R |
| 4,923,562 | 5/1990 | Jucha et al. | 156/643 |

OTHER PUBLICATIONS

Valentini et al., "Supersonic Atomic and Molecular Halogen Nozzle Beam Source", *Rev. Sci. Instrum.*, vol. 48, No. 1, Jan. 1977, pp. 58–63.

Flamm et al., "The Reaction of Fluorine Atoms With Silicon", *J. Appl. Phys.*, 52(5), May 1981, pp. 3633–3639.

Optovac, Inc. Brochure, 1982, pp. 5–9 to 5–12.

"Janaf Thermochemical Tables", *J. Phys. Chem. Ref. Data*, vol. 14, Suppl. 1, 1985, pp. 1011–1012.

Stinespring et al., "An Ultrahigh Vacuum Compatible Fluorine Atom Source For Gas–Surface Reaction Studies", *J. Vac. Sci. Technol.*, vol. 4, No. 4, Jul./Aug. 1986, pp. 1946–1947.

Geis et al., "Hot Jet Etching of GaAs and Si[a)]", *J. Vac. Sci. Technol.*, B 4(1), Jan./Feb. 1986, pp. 315–317.

Geis et al., "Hot–Jet Etching of Pb, GaAs, and Si", *J. Vac. Sci. Technol.*, B 5(1), Jan./Feb. 1987, pp. 363–365.

Cirillo et al., "Fluorine Oxidation of Rare Earth Dopant Ions in $CaF_2$ Single Crystals", *Journal of Crystal Growth*, 85 (1987) North–Holland, Amsterdam, pp. 453–460.

*Atomic and Molecular Beam Methods*, Edited by Giacinto Scoles, vol. 1, Oxford University Press, New York –Oxford, 1988, pp. 14–53.

*Atomic and Molecular Beam Methods*, Edited by Giacinto Scoles, vol. 1, Oxford University Press, New York –Oxford, 1988, pp. 83–123.

Harshaw Crystal Optics Catalogue, Englehard Corp., 1988, nine pages.

Levis et al., "A Hyperthermal 0.1–4eV) Fatom Beam Source Suitable For Surface Etching Investigations", *J. Vac. Sci. Technol.*, A 8(4), Jul./Aug. 1990, pp. 3118–3122.

M. Faubel, et al., "A High Resolution Crossed Molecular Beam Investigation Of The Absolute Cross Sections And Product Rotational States For The Reaction $F+D_2$", pp. 2106–2125.

Winters et al, "Surface Science Aspects of Etching Reactions", *Surface Science Reports*, North–Holland 14 (1992), pp. 161–269.

*Primary Examiner*—William Powell

*Attorney, Agent, or Firm*—Dunlap & Codding, P.C.

[57] ABSTRACT

A method and apparatus for generating a molecular or atomic fluorine jet or beam under vacuum for etching surfaces. The apparatus uses a hollow crystalline tube preferably fabricated from a crystal of a Group II fluoride such as magnesium fluoride. A terminal portion of the tube is heated to over 1000° C. and a mixture of fluorine gas and an inert carrier gas is induced under pressure into the tube. An atomic fluorine jet is emitted from the opposite end of the tube. The jet can be collimated into a beam and can be directed at masked surfaces for selective etching of the surface. The atomic fluorine source has a very high intensity resulting in rapid etching of materials and as a beam is capable of highly anisotropic etching. The jet may be primarily molecular fluorine if the tube is heated to a lower temperature.

39 Claims, 7 Drawing Sheets

METHOD AND APPARATUS FOR ETCHING SURFACES WITH ATOMIC FLUORINE

BACKGROUND

The present invention relates to a method and apparatus for etching surfaces, and more particularly to a method and apparatus for generating jets and beams of atomic fluorine for etching such surfaces.

Etching the surfaces of materials is a basic process in the semi-conductor, micro-electronics, and opto-electronics industries. Such processes are used to fabricate microscopically small electronic and optical components in integrated circuitry, optical components in solid-state lasers and light-emitting diodes, and mechanical parts for machinery, such as micromotors and microgears. Etching can also be used to shape materials, like diamonds, that are extremely hard or brittle, and are therefore extremely difficult to machine using mechanical means.

Current etching techniques fall into the broad categories of "wet" and "dry" etching. In wet-etching processes, materials to be etched are exposed to liquids or solutions of aggressive chemical agents, such as hydrofluoric acid, which remove, by chemical attack, areas of the material that are not protected by an overlain "mask" that is chemically resistant to the etchant. Subsequent removal of the mask then leaves the pattern of the mask permanently engraved into, or "etched" upon, the surface of the material.

Wet-etching techniques suffer from several disadvantages, which include: use of extremely corrosive and toxic solutions; safe disposal of same; difficulty in keeping etched materials free of particulates having sizes comparable to the etching patterns desired (on the order of microns or less and getting ever-smaller); and perhaps most fundamentally, preventing the "undercutting" of the material being etched. The last disadvantage arises from exposing the material, covered by the erstwhile mask, to the etching solution from the side as soon as the etching process has begun to take hold below the surface. Consequently, "dry" etching techniques have been developed which attack material primarily from the side with the mask, which therefore serves as a shield even after etching of the material has begun in earnest. These dry-etching techniques are called "anisotropic" since they do not etch the material at equal rates in all directions.

To achieve anisotropic etching, the etching agent must be aimed in a specific direction towards the surface of the material being etched. Consequently, such etching processes are conducted in the gas phase, and are therefore "dry". Anisotropy is most commonly achieved by steering charged particles (ion-beam etching) or by electrically charging the material being etched to attract ions of opposite charge. These techniques are known collectively as "reactive ion etching", and are sometimes assisted by further addition of uncharged, but chemically reactive gases in "chemically-assisted reactive ion etching". Ions of the etching agent are most easily created by electrical, microwave, or radio-frequency plasma discharges through low-pressure gases. However, such processes often damage delicate structures in the material being etched owing to electrostatic charging effects and sputtering by high energy ions. In addition, even though etching rates are often very low (about tens of nanometers per minute or less) because of the low gas densities, these gas densities are still high enough that the reactive species may experience gas—gas collisions in the vicinity of the material being etched, thereby reducing the anisotropy of the etching process.

There is therefore a need for developing an anisotropic dry-etching technique wherein: (a) the chemically reactive etchant species is electrically neutral, thus avoiding surface charging and sputtering effects; (b) the chemically reactive etchant species can be accelerated to "hyperthermal" velocities corresponding to temperatures of 10,000° K. or more, thus enhancing etching rates without sputtering; (c) the etching process operates at low background gas densities, thus avoiding loss of anisotropy due to gas—gas collisions; and (d) the etching process operates at high flux upon the material being etched, thus enhancing etching rates.

Ideally suited to these requirements is the "atomic beam" or "molecular beam" technique, wherein a stream of chemically reactive (uncharged) atoms or molecules is directed at the surface being etched. Rapid pumping of background gas being introduced in the beam results in the pressure within the beam being much higher than in the surrounding vicinity, thus enhancing etching anisotropy and possibly eliminating undercutting altogether.

Many dry-etching agents are based on chlorine- or fluorine-containing gases, which release chlorine or fluorine atoms or radical species containing them, upon dissociation or excitation in plasma discharges. However, atomic beams of chlorine, and especially fluorine, are difficult to generate in high fluxes owing to their reactive nature. The high gas reactivity, desirable for etching, necessarily destroys many conventional materials required for tubing within which to heat the gas for atom production.

Atomic fluorine is one of the most potent dry-etching agents, especially for etching silicon, the principal material of micro-electronics industries. The spontaneous etching of silicon by atomic fluorine and molecular fluorine beams has been studied in great detail, and the fluorine-silicon system is the most frequently chosen for directed beam studies. Exposure to hyperthermal beams, and to atomic fluorine instead of molecular fluorine, greatly enhances etching rates.

There are currently two common methods used for generating atomic fluorine: the fluorine-containing gas (usually carbon tetrafluoride, sulfur hexafluoride, xenon difluoride, or elemental molecular fluorine) is passed either through a plasma discharge tube (Stinespring, C. D.; Freedman, A. and Kolb, C. E., "An Ultrahigh Vacuum Compatible Fluorine Atom Source For Gas-Surface Reaction Studies", *J. Vac. Sci. Technol. A*, Vol. 4, No. 4, Jul/Aug 1986, pp. 1946–1947), or through a heated metallic tube. In etching studies the microwave discharge is the more common of the two methods because it avoids the problem of trace amounts of metallic fluorides that may condense on the target surface. In both cases however, the chief limiting factor is the low atomic beam intensity, which in turn limits expected etching rates. For plasma sources, this is due to the low gas pressure (typically a few torr or less), which result in typical fluxes for atomic fluorine of about $10^{14}$–$10^{16}$ atoms/cm$^2$-sec (corresponding to pressures of only $10^{-7}$–$10^{-5}$ torr). Also, the usual material of choice for the gas containment, a ceramic tube fabricated from alumina ($Al_2O_3$), must be replaced regularly due to corrosion by fluorine (other crystalline materials such as quartz are also rapidly etched by hot fluorine).

Only two metals have been found to withstand the corrosive action of fluorine at temperatures high enough to induce substantial thermal dissociation. Using nickel at temperatures no higher than 1000° K. allows intense beams to be generated, but with very poor atomic dissociation yields (about 15% or less). Fluorine rapidly destroys the nickel at higher temperatures, and even lower yields (5% or less) are usually tolerated to improve beam stability.

U.S. Pat. No. 4,734,152 discloses using iridium tubes to generate low pressure gas "jets", but only at the low fluxes and directionality obtainable from open-ended tubes. This gas jet technique is unstable however, since the iridium tube used for heating and conveying the fluorine is destroyed at temperatures below 1750° K., while the alumina tube used to pre-heat the gas would be etched rapidly for temperatures above 1200° K. if molecular fluorine had been used. The iridium source allowed brief and erratic use of sulfur hexafluoride as the atomic fluorine precursor, permitting measurement of relatively fast etching rates (hundreds of nanometers per minute), though it is not clear whether the active etchant was atomic fluorine or some lower fluoride of sulfur.

Finally, laser-induced dissociation of xenon difluoride has been used to produce intense, high-energy pulses of atomic fluorine. However, the beam lasts only as long as the laser pulse (about 5 nanoseconds), and its high instantaneous intensity is reduced by a factor 200 million since it can only be fired once per second.

It would be advantageous to develop a technique that generates atomic fluorine cleanly by heating molecular fluorine, directly inducing thermal dissociation. An atomic fluorine beam having a high local pressure and/or hyperthermal kinetic energy would drastically speed etching rates, and would improve etching anisotropy, without damaging surface structures by charging or sputtering effects. Using molecular fluorine as the atomic precursor avoids the production of possible by-products or particulates like elemental sulfur from sulfur hexafluoride or elemental carbon from carbon tetrafluoride. Additionally, dissociation of molecular fluorine requires only one-half the energy required for dissociating sulfur hexafluoride, and only one-third the energy required for dissociating carbon tetrafluoride.

DESCRIPTION OF THE INVENTION

Figure 1:
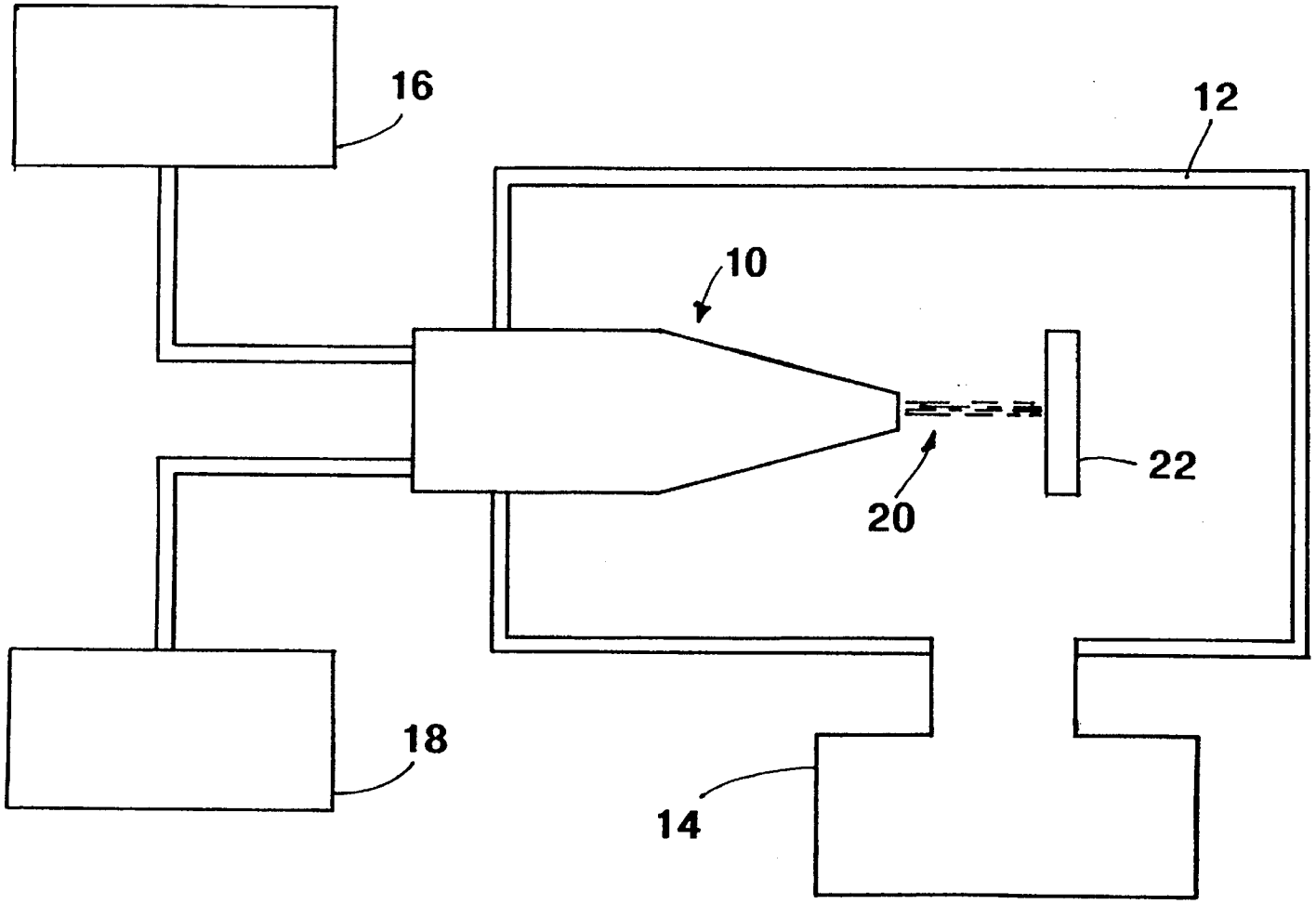
FIG. 1 is a schematic of the gas jet assembly, etching target, and the associated vacuum, gas inlet, and electrical equipment.

The uniquely high intensity source of atomic fluorine described herein can be used to etch almost any material at rates much faster than heretofore realized. Some especially hard materials, such as diamond, can easily be etched without leaving any residue since the carbon tetrafluoride product is gaseous (even without heating). The importance of developing the high-intensity atomic beam source described herein lies in its approximately thousand-fold increase in beam intensity over microwave plasma sources currently in use, allowing corresponding increases in etching throughput.

Etching of materials is a basic process in the semiconductor and micro-electronics industries. Atomic fluorine sources have also been used for a variety of purposes in generating chemical lasers, in studies of molecular collision dynamics, and in spectroscopy. All of these areas would be assisted by the easier and much more intense production of atomic fluorine.

The present invention therefore comprises a new method and apparatus for generating a jet or beam of atomic fluorine generally at temperatures above 600° C. At temperatures below 600° C., the jet or beam is generally comprised of molecular fluorine. In the preferred embodiment this invention uses a magnesium fluoride tube fabricated from a single crystal for heating molecular fluorine ($F_2$) gas to temperatures sufficiently high to cause almost complete dissociation into atomic fluorine. This accomplishes the purpose of generating a much more intense, and far more convenient, atomic fluorine source than any previous developed.

The tube may also be made from calcium fluoride, strontium fluoride, or barium fluoride. These fluorides are uniquely resistant to hot fluorine despite its extreme corrosiveness at high temperatures. Glass, quartz, fused silica, and other crystalline materials are rapidly destroyed by fluorine at temperatures exceeding 400° C., and even alumina and sapphire suffer significant corrosion above 700°–800° C.

The Group II fluoride tubes described herein have corrosion rates of less than 100 nm/min when heated to temperatures above 800° C. The crystalline tubes used herein preferably have corrosion rates of less than 10 nm/min, preferably of less than 4 nm/min, and most preferably of less than 1 nm/min. Corrosion rate where used herein means the rate at which the inner surface of the tube at the outlet end is etched away. The corrosion rates of such crystalline materials as quartz, alumina and sapphire are much higher than the materials used in the present invention. For example, at the relatively low temperature of 400° C., quartz has a corrosion rate on the order of 10 μm/min. The rate would be higher at higher temperatures. Alumina and sapphire both have corrosion rates of at least about 5 μm/min at temperatures over 800° C. As a result, tubes fabricated from these materials would corrode rapidly at the temperatures (over 800° C.) which are in the preferred operating range of the present invention. The present invention may comprise a tube constructed from any crystalline material which has a melting point higher than 800° C. and which has a corrosion rate of less than 100 nm/min when a fluorine gas is passed therethrough when the outlet end is heated to a temperature higher than 800° C. Any such crystalline tube more preferably has a corrosion rate of less than 10 nm/min, even more preferably of less than 4 nm/min, and most preferably of less than 1 nm/min.

No metallic materials or alloys are resistant in the 700°–1450° C. temperature range, including pure nickel and its corrosion-resistant alloys. In the 1450°–2250° C. temperature range, iridium metal has purportedly been found to be somewhat resistant (U.S. Pat. No. 4,734,152), but conveying hot fluorine to an iridium tube, coupled with sealing difficulties at these temperatures, make this approach very difficult to implement. This approach is also based on use of sulfur hexafluoride, which may generate undesirable by-products, such as elemental sulfur.

This new source can be used for fundamental studies in materials etching, chemical lasers, molecular collision dynamics, and spectroscopy. Of particular interest is its applicability to commercial etching processes in the semiconductor and micro-electronics industries. The materials of construction allow the new source to be used directly in baked and unbaked ultra-high vacuum systems.

The materials listed are all fluorides of the metals in Group II of the Periodic Chart of the Elements. They all have only one oxidation state, and therefore can neither gain nor lose fluorine easily, and they all have high melting points (Magnesium fluoride: 1250° C.–1261° C.; Calcium fluoride: 1360° C.–1423° C.; Strontium fluoride: 1450° C.–1473° C. and Barium fluoride: 1280° C.–1355° C.). For reasons unrelated to their inertness towards fluorine, they are all excellent optical materials, and are therefore readily commercially available as high-purity single crystals. They are almost completely insoluble in water and do not absorb moisture from the air. Some of these desirable characteristics are also shared by a few other fluorides, including aluminum fluoride, cadmium fluoride, sodium fluoride and sodium aluminum fluoride. Another class of suitable fluorides having low water solubility and high melting points (1000° C. or higher) are the Lanthanide fluorides.

The crystalline fluorides used herein preferably have purities exceeding 98%. Cast tubes of 98% pure calcium fluoride, supplied by Custom Technical Ceramics (Arvada, Colo.), were rapidly destroyed. Best results are obtained with a purity of at least 99.9%. Magnesium fluoride of this purity is commercially available, for example as an unfinished boule (rod) approximately six inches long from Optovac (North Brookfield, Mass.). Magnesium fluoride ("mosaic" or "optical" grades) is the preferred material due to its resistance to cleavage and to thermal shock, rendering it the most conveniently machinable of the Group II fluorides.

Since atomic fluorine etching has been studied, and used extensively in the semi-conductor and micro-electronics industries, we believe that commercialization of an intense, reliable, rugged, and easily-used atomic fluorine source would generate substantial commercial potential in these industries, as well as in research laboratories.

The present invention has a number of commercial advantages. It can be constructed compactly and neatly, with relatively few components. Mounting can be modular, permitting use with a wide variety of commercial or research instrumentation. Components that wear out (e.g., the heating system) can be readily and inexpensively replaced. These characteristics, together with the invention's uniquely high intensity, make atomic fluorine etching safer, easier, more efficient and more economical.

The present invention comprises a directed beam of neutral (uncharged) fluorine gas atoms or molecules obtained by allowing a high-pressure fluorine gas to expand through a small orifice into a low-pressure region maintained at pressures below $10^{-3}$ torr. Because of these low pressures, obtained after the expansion of gas into the vacuum, the gas atoms and molecules travel without deflection by other gas atoms and molecules. These directed beams may therefore easily be aimed at specified targets, while maintaining locally high densities.

When used herein the term jet or beam generally refers to a directed stream of atoms or molecules having minimal gas-to-gas collisions therein. Further, the jet or beam generally has locally high pressures which are usually at least about a factor of ten and preferably 1000 times higher than outside the jet or beam. The jet or beam preferably has hyperthermal energies, i.e., in excess of 10,000° K. The jet or beam generally has a high intensity of up to about 0.1 torr and a flux in excess of $10^{17}$ atoms/cm$^2$/sec. The term beam when used herein specifically refers to a beam wherein the atoms travel without gas-to-background collisions, due to a lowering of the background gas pressure resulting from use of additional vacuum pumping.

Beams obtained by expanding a gas from pressures above 0.1 atm through a small orifice (the "nozzle") into a vacuum exhibit the highest beam intensities and are called "supersonic beams" or "supersonic jets". Nozzle diameters used are generally in inverse proportion to the gas pressure so that the gas flow will not overload the vacuum pumps. With a gas flow of 1 standard liter per minute or less, optimized jets and beams are obtained with nozzle diameters of 0.002–0.040 inches and gas inlet pressures of 0.1–10 atm.

The supersonic beam technique also facilitates control over the kinetic energy of the gas atoms. Diluting a "seed" gas (such as fluorine) in a "carrier" gas of lower atomic or molecular weight increases the kinetic energy of the seed gas to hyperthermal velocities (10,000° K. or greater), with only modest intensity losses relative to a beam of the pure gas (roughly a factor of 2–4 for a 10–20× dilution factor). Conversely, diluting a seed gas in a carrier gas of higher atomic or molecular weight decreases the kinetic energy of the seed gas, but causes exaggerated intensity losses relative to a beam of the pure gas.

The kinetic energy of the atomic fluorine is controllable by varying the dilution of fluorine in the inert gas diluent, as well as by choosing the atomic or molecular weight of the diluent. This controllability is available only because the source uses the supersonic beam expansion technique which, to achieve high intensity of atomic fluorine by thermal dissociation, requires high pressures (up to 10 atm), and consequently high temperatures (exceeding 800° C.) to achieve good atomic dissociation yields. The maximum attainable kinetic energy is on the order of 1.6 eV for fluorine atoms and up to 3.2 eV for fluorine molecules, equivalent to a temperature of ≈18,000° K. for atomic fluorine, and ≈36,000° K. for molecular fluorine.

Heating must be concentrated near the terminal end of the source tube to ensure high dissociation efficiency and to prevent excessive heat transfer to the surroundings, which can be destroyed by the fluorine gas. This is accomplished by using a small radiative heater, coupled with specially-designed radiation shielding.

At the gas pressures required for producing intense supersonic beams, the dissociation of more than a few percent of molecular fluorine into atomic fluorine generally necessitates temperatures at or above 800° C. Between temperatures of 600° C. and 800° C. the fluorine is generally at least partially atomic but is mostly molecular. Since the dissociation constant depends on the temperature exponentially, optimum temperatures for intense beams are 1000° to 1200° C., where only the fluorides listed herein are resistant to fluorine.

Preferably, the heating system is able to generate temperatures at or above 1000° C. at the terminal end of the crystalline tube where the fluorine is delivered into the vacuum. At these temperatures, the principal heat loss mechanism is due to radiative heat transfer. The front end of the crystalline tube cannot be completely shielded, because such shielding would cause gas from the beam to be scattered from solid surfaces back into the beam path, thus reducing its intensity. Despite these unavoidable radiative heat losses, optimum performance requires that the tube tip be hotter than any other point along the crystalline tube. Failing this, the lower operating temperature at the tip inhibits thermal dissociation of the molecular fluorine, reducing the atomic fluorine intensity. Furthermore, a relatively cool tip condenses crystalline material that may sublime at the higher temperatures deeper inside the tube, and may result in clogging the tube's nozzle opening.

As an electrical insulator, the crystalline tube is preferably heated indirectly. The preferred technique is resistive heating of an electrical conductor held in close thermal contact with the tip of the crystalline tube. Heating must be carefully controlled, since operating temperatures up to 1150° C. (for magnesium fluoride) are desired despite a melting point of 1250°–1261° C. (for magnesium fluoride). Other crystalline tubes contemplated herein may have even higher operating temperatures. Suitable electrical conductors for the heater are able to operate at temperatures preferably at or above 1500° C., and include tantalum, tungsten, molybdenum, rhenium, niobium, iridium, graphite, and silicon carbide.

All gas jet assembly components other than the compression seal required for sealing the crystalline tube are made from materials (stainless steel, copper, nickel, tantalum, alumina, sapphire, and magnesium fluoride) that are strictly compatible with "ultra-high vacuum" (pressures below $10^{-8}$ torr). All these materials can also be heated to 200° C. during vacuum "bakeout", which is used to hasten pumping down to ultra-high vacuum. The compression seal may also be made compatible with ultra-high vacuum practice provided a high-temperature elastomer is used and provided further that the elastomer presents a small cross-sectional area to the vacuum.

Referring now to FIG. 1, the present invention contemplates a gas jet assembly designated generally by the reference numeral 10. The gas jet assembly 10 is at least partially enclosed within a vacuum chamber 12 which has a vacuum system 14 for causing a vacuum in the vacuum chamber 12. Fluorine gas is supplied to the gas jet assembly 10 by a gas source 16.

A current source 18 is connected to the gas jet assembly 10 for heating a portion thereof. During operation of the gas jet assembly 10, a fluorine gas mixture is introduced into the gas jet assembly 10 for forming an atomic fluorine jet or beam 20 which is then used to etch a portion of an etching target 22 disposed within the vacuum chamber 12.

Figure 2:
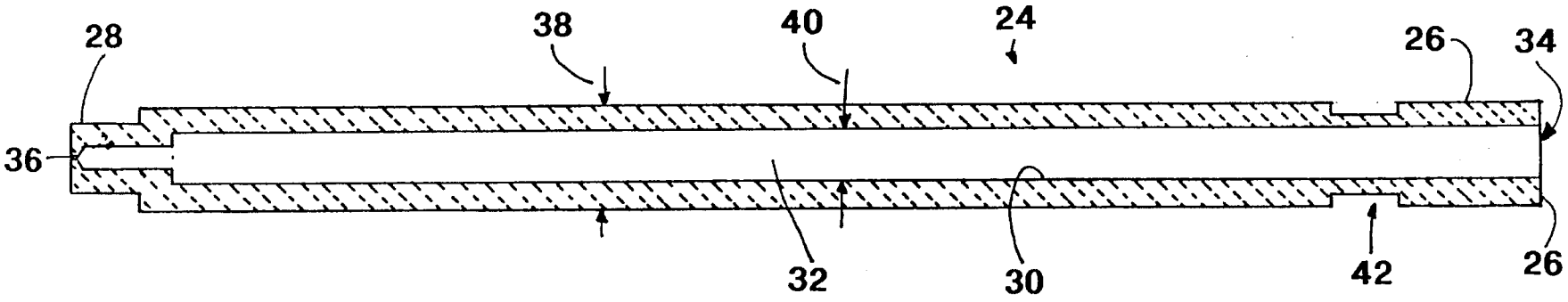
FIG. 2 is a side sectional view of the crystalline tube of the gas jet assembly.

Of central importance to the gas jet assembly 10 is a crystalline tube 24, shown in FIG. 2, which is preferably constructed of high-purity, single-crystal magnesium fluoride. The crystalline tube 24 can also be fabricated from calcium fluoride, strontium fluoride, or barium fluoride, or operable combinations thereof and is preferably at least 98% pure. Suitable crystalline materials from which the tubes can be fabricated are available commercially, for example from Optovac (North Brookfield, Mass.). As shown in FIG. 2, the crystalline tube 24 has an inlet end 26, an outlet end 28, and an inner surface 30 which encompasses an inner lumen 32. The inlet end 26 has an inlet opening 34 and the outlet end 28 has a nozzle opening 36 which communicates with the inner lumen 32. The crystalline tube 24 preferably has an external diameter 38 of approximately 0.375 inches and an internal diameter 40 of approximately 0.187 inches and a nozzle opening diameter of approximately 0.006 inches. The dimensions are, of course, only exemplary of the preferred embodiment. Other dimensions which allow the apparatus to function in accordance with the present invention can be used if desired. The crystalline tube 24 further has a sealing groove 42 near the inlet end 26 for use in sealing the inlet end 26 of the tube.

Figure 3:
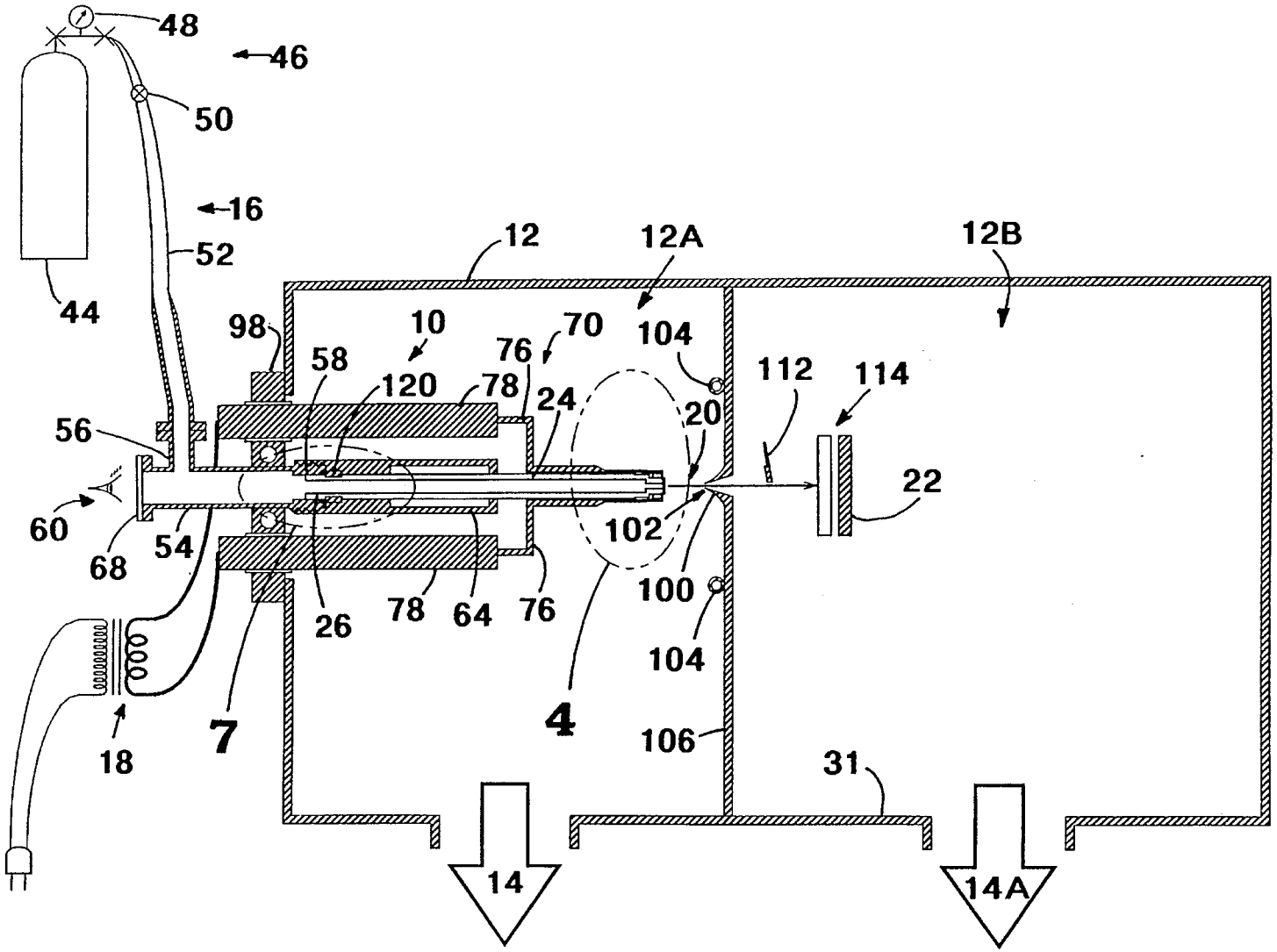
FIG. 3 is a more detailed side view of the gas jet assembly and the vacuum chamber.

The gas source 16 shown in FIG. 3 further comprises a gas cylinder 44 and a regulator assembly 46 which may comprise a pressure reduction regulator 48 and a gas flow controller 50, such as are well known in the art. The regulator assembly 46 is connected to a gas line 52 which is connected to a gas portal 54. The portal 54 has an inlet port 56, and is integral with a flange housing 58, and, in a preferred embodiment, a window end 60. The flange housing 58 receives the inlet end 26 of the crystalline tube 24 as is discussed in more detail below in FIG. 7.

Fluorine gas, diluted in an inert carrier gas, is obtained from a high-pressure mixture contained in the gas cylinder 44. The gas pressure is regulated to an operating pressure in excess of 0.1 atm, up to 100 atm, but preferably less than 10 atm by the pressure-reduction regulator 48 and the gas-flow controller 50. The gas mixture, cylinder 44, and regulator 48 must all be compatible with fluorine use, and are available commercially, for example from Air Products (Hometown, Pa.). The gas-flow controller 50 must also be compatible with fluorine use, and is available commercially, for example from Sierra Instruments (Monterey, Calif.). The molecular fluorine in the gas mixture in the cylinder 44 may be diluted by helium, neon, nitrogen, argon, krypton, or xenon, or any suitable mixture of these inert gases, and is conveyed from the gas cylinder 44 through metal or plastic gas line 52. The preferred mixture is a mixture of fluorine and helium. Preferred materials for metal tubing are copper, stainless steel, nickel, monel, or inconel; preferred materials for plastic tubing are teflon or other compatible materials such as Kynar®, available from Cole-Parmer (Chicago, Ill.).

The lighter gases allow production of more intense and energetic beams of atomic fluorine (up to 1.6 eV), while the heavier gases can be used if lower kinetic energies are desired (down to 0.05 eV). Optimum intensity and kinetic energies are obtained for a mixture of about 5% molecular fluorine in helium.

Figure 7:
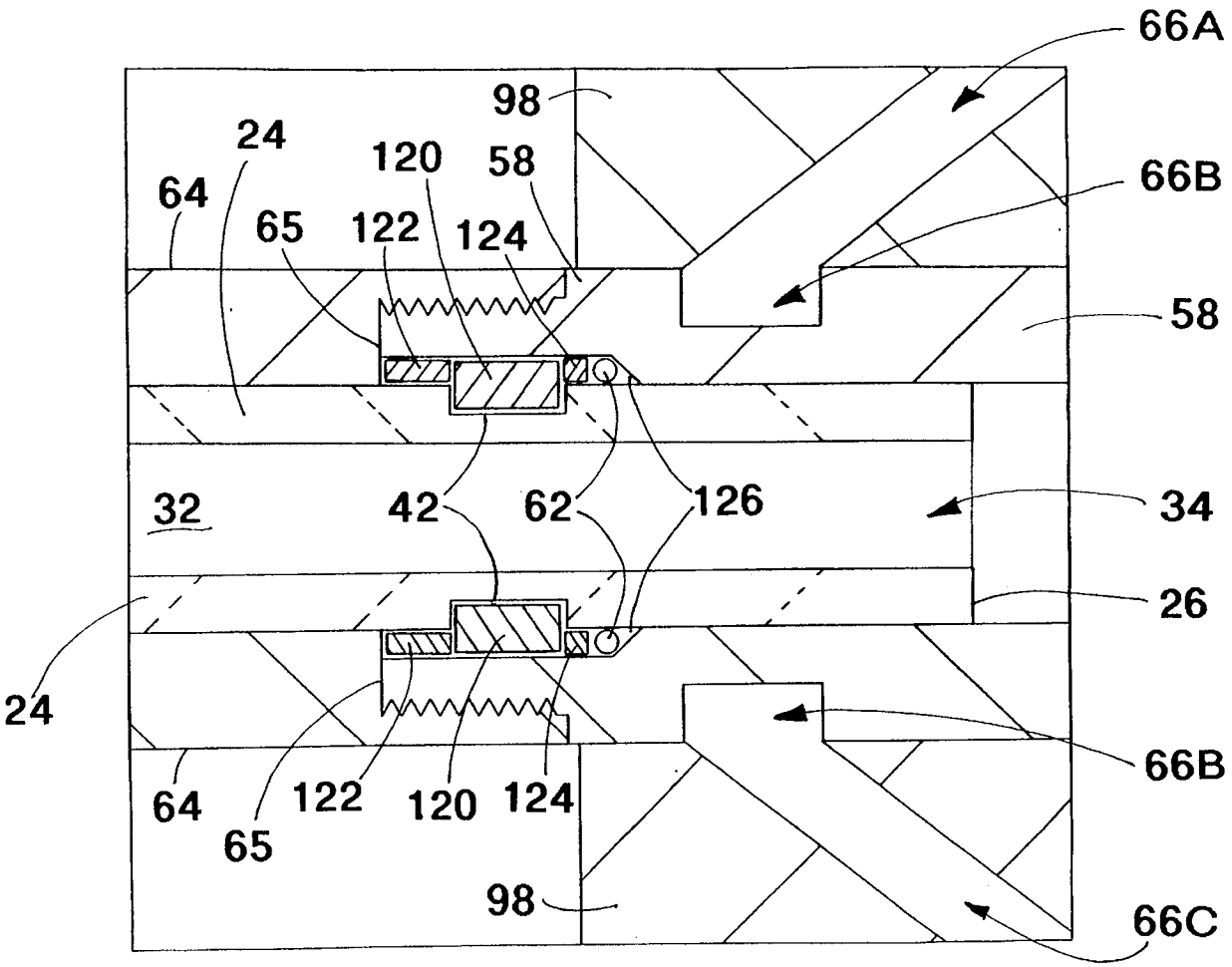
FIG. 7 is an enlarged side view of the sealed junction of the tube and flange.

As shown in FIG. 7, sealing of the inlet end 26 of the crystalline tube 24 within the flange housing 58 is accomplished using a threaded tube 64 having a butting end 65 which provides the sealing force against a compression seal 62 and also serves to align mechanically the inlet end 26 of the crystalline tube 24 rigidly within the flange housing 58. The compression seal 62 utilizes any commercially available fluorine-resistant elastomer such as Viton® or (preferably) Kalrez® O-rings, available from Parker (Lexington, Ky.) and DuPont (Newark, Del.), respectively. A standard Ultra-Torr® type of vacuum fitting available commercially from Cajon (Macedonia, Ohio) may also be used. In all cases, care must be taken to mechanically retain the tube, especially at the higher gas pressures used. The compression seal 62 is preferably maintained below about 200° C., which is accomplished by a cooling system 66 disposed near the seal 62 in a connecting flange described in more detail below.

A transparent pressure/vacuum window 68 is disposed in the window end 60 of the gas portal 54 which allows telescopic observation through the lumen 32 of the crystalline tube 24, even during operation and from outside the vacuum. Such observations permit in situ inspection of the nozzle opening 36 to verify the absence of sublimation, crystal growth, or chemical attack. The transparent window 68 also permits "optical pyrometry" for non-contact temperature measurements. For this purpose, the inner surface 30 of the crystalline tube 24 is preferably left unpolished after machining. Optical verification of alignment during actual operation is also possible through the window 68. The preferred material for window 68 is sapphire, available commercially, for example, from Meller Optics (Providence, R.I.), because of its mechanical strength, resistance to fluorine attack (corrosion), and transparency throughout the visible and near-infrared optical regions. Other materials from which the window 68 could be fabricated are magnesium fluoride, calcium fluoride, strontium fluoride, barium fluoride, quartz, and fused silica. It will be appreciated however that any material which functions in accordance with the present invention and is resistant to degradation by unheated fluorine could be used. Diffraction of a visible-wavelength laser shone through the window 68 and through the nozzle opening 36 permits accurate and continuous monitoring of the nozzle diameter, even during operation.

The gas jet assembly 10 further comprises a heating assembly 70 for heating the end portion of the crystalline tube 24 during its operation. As shown in more detail in FIGS. 4 and 5, the heating assembly 70 comprises a heating collar 72 constructed from a highly refractory material, preferably tantalum. But other refractory metals or materials such as tungsten, molybdenum, rhenium, niobium, iridium, graphite and silicon carbide may be used. In other methods of heating the outlet end 28 of the tube 24, the heating assembly 70 may comprise radiative, conductive or electromagnetic heating mechanisms, which may include, but are not limited to, infra-red radiation, hot wire, thin film ohmic, electron or laser bombardment or inductive or high-frequency electromagnetism.

The outlet end 28 of the tube 24 is concentrically surrounded by an insulating collar 74 which is preferably constructed from alumina but may be constructed of any suitable material which functions in accordance with the present invention, for example, ceramic insulators such as zirconia, magnesia, beryllia, boron nitride and others known to those of ordinary skill in the art. The heating collar 72 surrounds and engages in close thermal contact the insulating collar 74. In a preferred version, the heating collar is about 0.005 inches thick and about one-eighth inch wide. The heating collar 74 is connected to metallic leads 76 which are attached to metallic rods 78. The leads 76 are preferably of the same material used to construct the heating collar 72, for example, preferably tantalum. The rods 78 are preferably composed of copper, but may be composed of any suitable metal, and are connected to the current source 18. The current source 18 may be any standard transformer plugged into, or powered by, any suitable means, such as by 110 VAC electrical service. In the present embodiment, the copper rods 78 are about three-eighths inch in diameter. Each lead 76 may be of varying thickness along its length. Due to variations in the thickness of the metallic leads 76, the optimum current and voltage requirements vary by 20–30%.

The insulating collar 74 has two blind holes drilled parallel to the crystalline tube 24 to accommodate standard thermocouples 80, available commercially, for example, from Omega (Bridgeport, N.J.).

In the preferred mode of operation, the outlet end 28 of the crystalline tube 24 is heated to 800° C. or greater by passing for example, 80 A of current at 3 V through the heating collar 72 which is wrapped around the insulating collar 74, which is in turn concentric to, and in close thermal contact with, the tip of the crystalline tube 24 as described above. The outlet end 28 of the tube 24 may be heated to temperatures lower than 800° C., even as low as room temperatures of around 20° C., for purposes wherein a jet or beam of molecular, or only partially atomic (and partially molecular) fluorine is desired, or where a beam with lower kinetic energy is desired. Preferred heating ranges are from about 1000° C. to within about 10°–20° C. of the melting point of the crystal. For the types of crystalline tubes, the preferred ranges for example are: Magnesium fluoride: 1000° to 1250° C.; Calcium fluoride: 1000° to 1350° C.; Strontium fluoride: 1000° to 1450° C. and Barium fluoride: 1000° to 1250° C.

Figure 4:
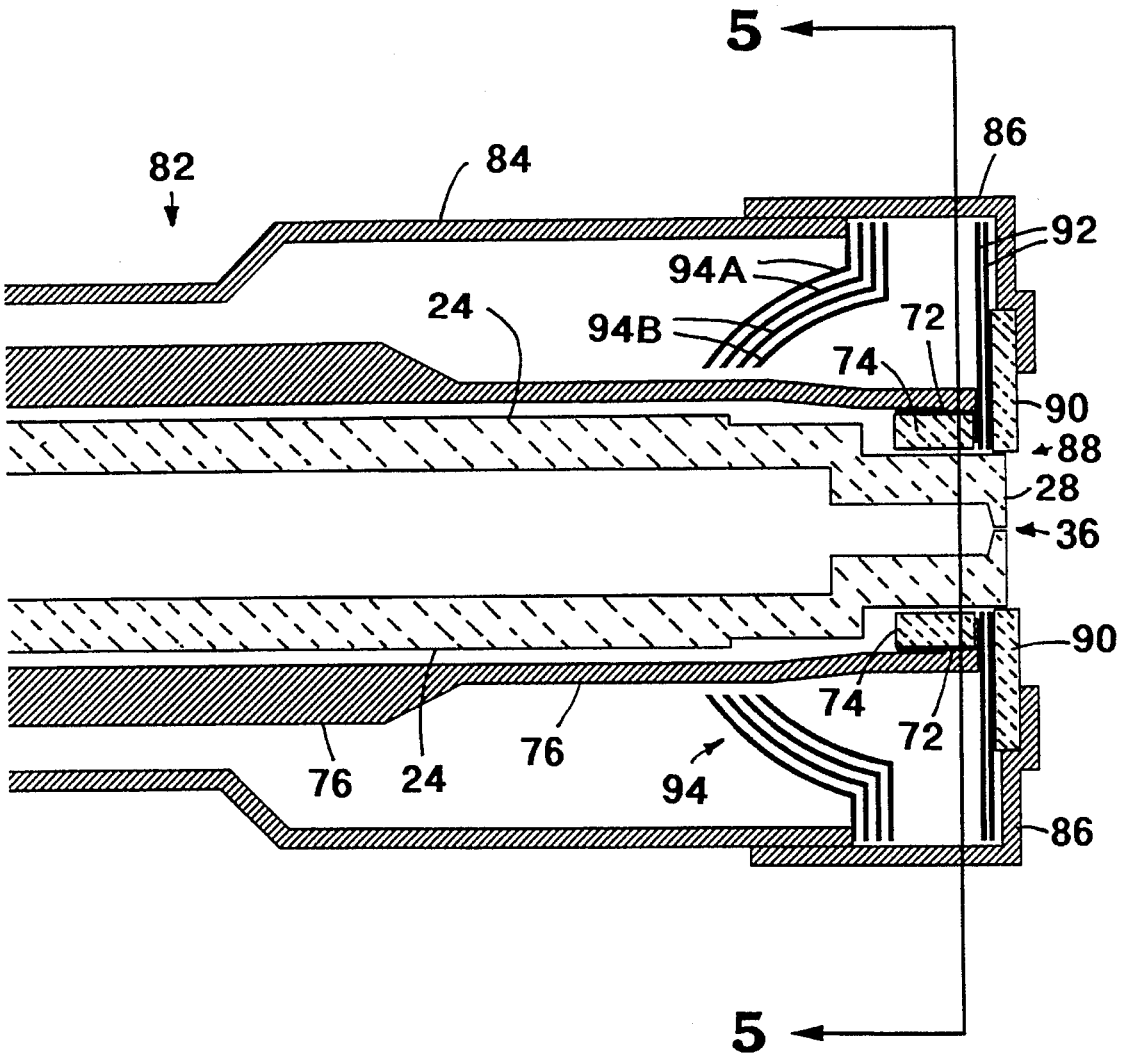
FIG. 4 is an enlarged side view of the end portion of the tube, heater and radiation shielding.
Figure 5:
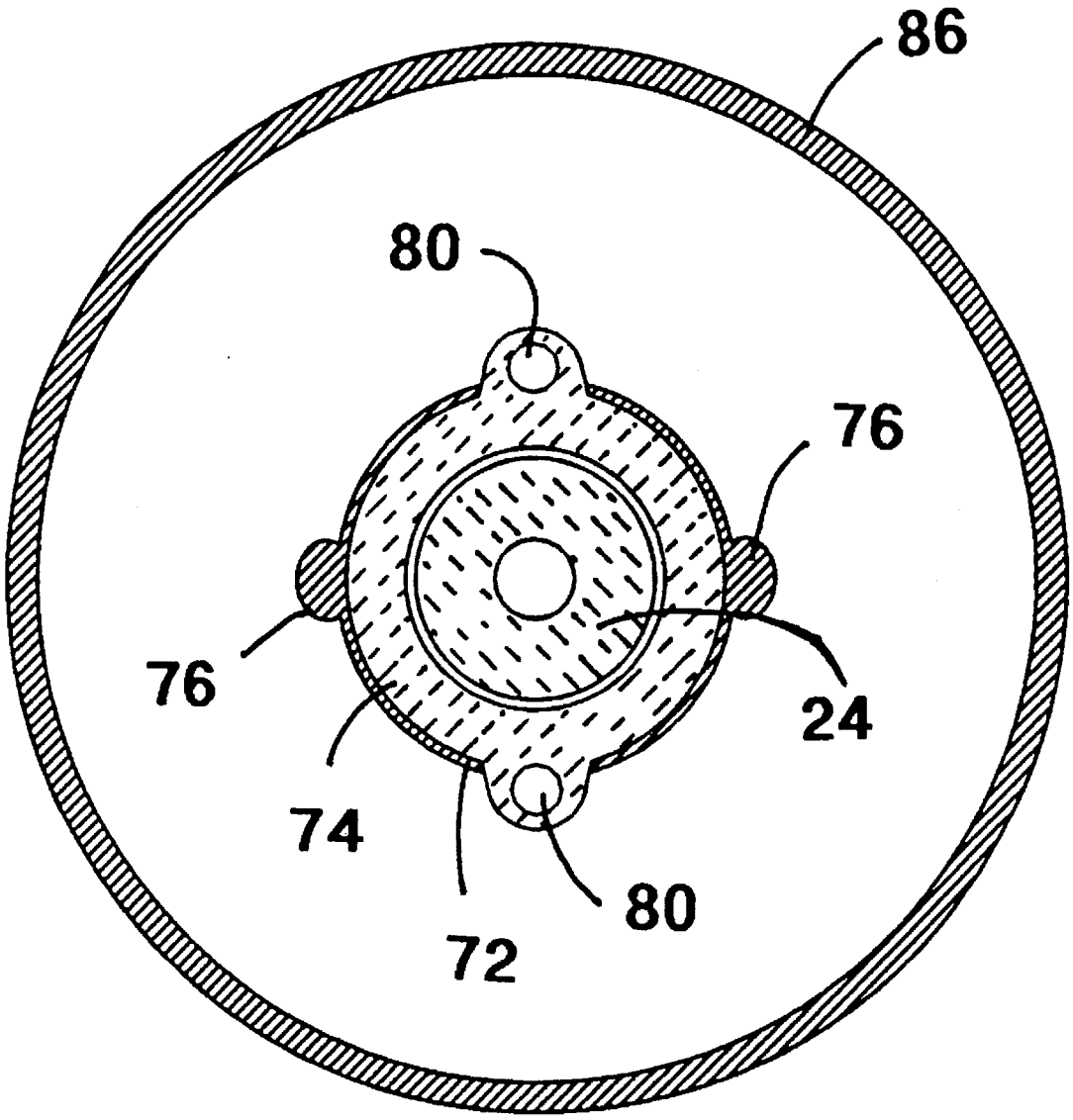
FIG. 5 is a front sectional view through the tube, shielding and heating system.
Figure 6:
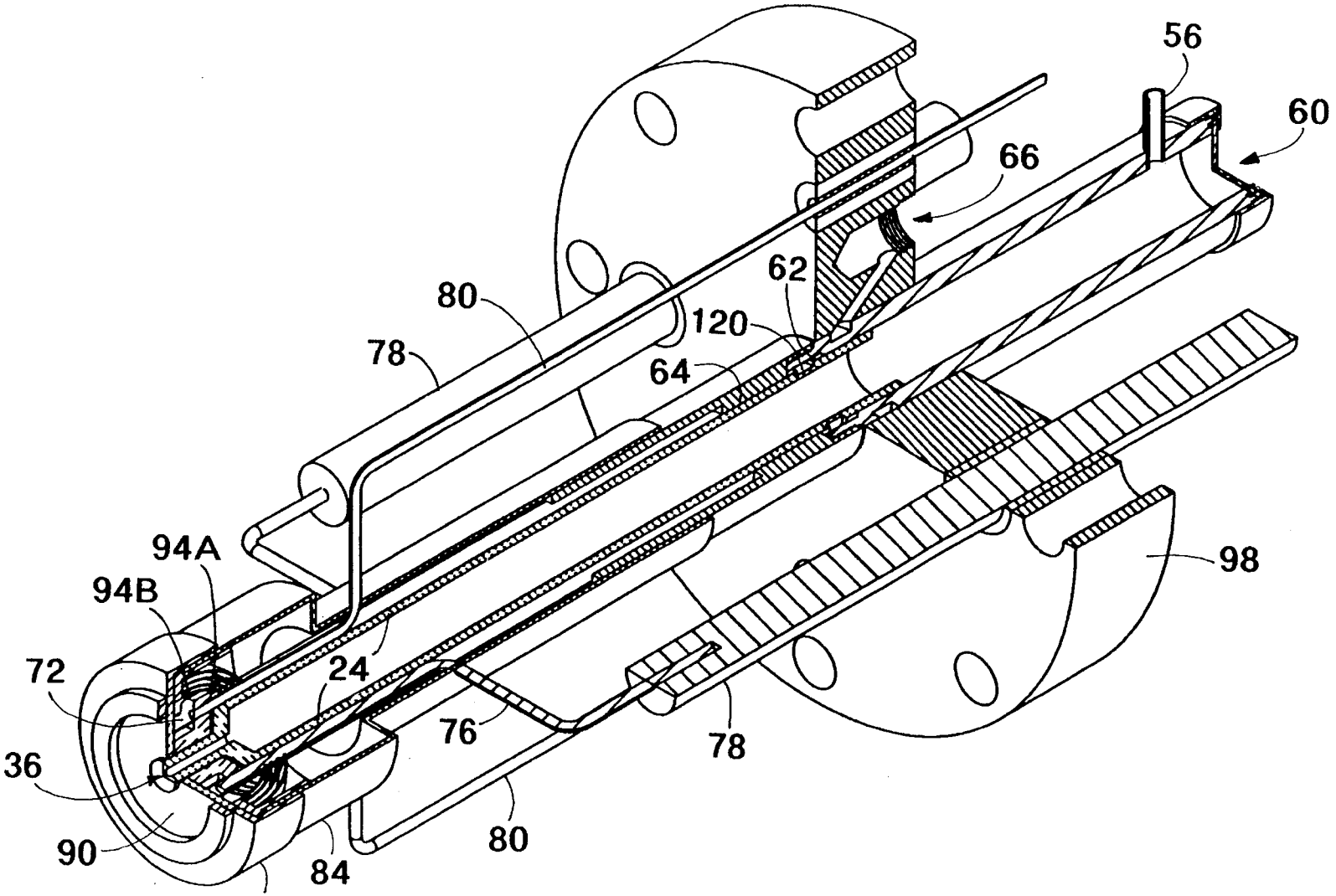
FIG. 6 is a perspective view with a partial cut away view of the tube, heater, shielding and connecting flange.

The heating collar 72, insulating collar 74, portions of the metallic leads 76, and all but the very tip of the crystalline tube 24 are enclosed in an outer shielding tube 82 and a metal threaded tube 64 fabricated from suitable metals, such as stainless steel and nickel. The shielding tube 82 is not shown in FIG. 3 but is shown in FIGS. 4–6. The shielding tube 82, in a preferred embodiment is comprised of a body portion 84 which comprises the body of the tube 82 and an end portion 86 which has an end opening 88. Partially disposed over the end opening 88 and disposed flush against the inner surface of the end portion 86 is protector disc 90 which serves as a shield to protect inner components from chemical attack by the atomic fluorine generated during operation. The disc 90 has an opening through which the outlet end 28 of the crystalline tube 24 is exposed. The front protector disc 90 must be somewhat resistant to fluorine attack at high temperature, and is preferably an electrical insulator to avoid short-circuiting the heating collar 72.

The protector disc 90 is preferably constructed from sapphire, which is commercially available, but may be constructed from other suitable materials, including alumina and boron nitride. Disposed proximally from the disc 90, inward from the end portion 86 of the tube 82 may be additional shielding discs 92, comprising, for example nickel and/or tantalum, for providing radiation shielding as a form of thermal insulation. Sapphire is available for example from Meller Optics (Providence, R.I.).

Further, disposed behind the end portion 86 of the shielding tube 82 is a heater shield 94 having a concave shape. The heater shield 94 may be comprised of one or more separate layers **94*a* and 94*b* constructed from metals, such as nickel or tantalum. For example, the heater shield 94*a* may be constructed from two layers of nickel, each 0.005 inches thick and heater shield 94*b* constructed from two layers of tantalum, each 0.005 inches thick. The tantalum layers 94*b* are preferably closest to the heating collar 72. The heater shield 94 functions to focus heat generated by the heating collar 72 onto the nozzle end 28 of the tube 24 for enhancing the effect of the heating collar 72 on the nozzle end 28 and ensuring that the nozzle end 28 will have the highest temperature of any portion of the crystalline tube 24**.

The surface of the outlet end 28 of the crystalline tube 24 is preferably within approximately one-eighth inch of being flush with the protector disc 90 mounted in the shielding tube 82. This outlet end 28 has a nozzle opening 36 drilled in its center, which as described above, serves as the nozzle opening 36 for supersonic expansion of the high-pressure molecular fluorine gas mixture issuing into the vacuum as the atomic fluorine jet 20. The diameter of the nozzle opening 36 is generally in a range of from 0.002 inches to 0.040 inches, but may exceed this. More preferably the diameter is in a range of from 0.004 inches to 0.015 inches. More preferably still the diameter is in a range of from 0.004 inches to 0.010 inches. Preferably, the nozzle opening 36 should not protrude more than about one-eighth inch in front of the heating collar 72, because doing so would cool the nozzle end 28 and would inhibit thermal dissociation of the molecular fluorine. Conversely, the nozzle opening 36 preferably should not be withdrawn more than about one-eighth inch behind the protector disc 90, because doing so would increase gas buildup in the vacuum immediately outside the nozzle opening 36, thereby reducing the intensity of atomic jet 20.

The gas jet assembly 10 is mounted on any suitable flange 98, such as a four and one-half inch Conflat® flange, which is available from Varian (Lexington, Mass.). The flange 98 is used to seal the gas jet assembly 10 to the vacuum chamber 12. This mounting is mechanically rigid and maintains its alignment as the crystalline tube 24 is heated from room temperature to operating temperature. The assembly 10 is completely modular, allowing easy adaptability to a wide variety of vacuum processing and research instruments. A vacuum compartment 12*a* of the vacuum chamber 12 contains the assembly 10 and during operation is evacuated by a vacuum system 14, preferably one with pumping speeds of 1000 liters/sec or more for attaining pressures of $10^{-2}$ to $10^{-5}$ torr or below. The vacuum system 14 preferably maintains a pressure below $10^{-3}$ torr while handling gas flows up to 1 standard liter per minute. The requisite pumping speeds of 1000–20000 liters/sec are available using diffusion, turbo-, or cryo-pumps.

In one version of the invention, the atomic fluorine jet 20 which emerges from the nozzle opening 36 can be collimated, if desired, by a sharp-edged "skimmer" cone or collimator 100 having a small orifice 102 (preferable diameter of 1 mm) at its tip. The skimmer cone 100, immersed in the atomic fluorine jet 20, is preferably fabricated from nickel for corrosion resistance. The skimmer cone 100 is water-cooled by a cooling system 104 which is attached to a plate 106 that also serves to separate the relatively weaker vacuum in the vacuum compartment 12*a* having the gas jet assembly 10 therein from a stronger vacuum in an etching target chamber compartment 12*b*.

Using the technique of differential pumping, the etching compartment 12*b* is evacuated by vacuum pumps 14*a* with pumping speeds of 100 liters/sec or more for attaining pressures of $10^{-4}$ to $10^{-7}$ torr or below. At these lower pressures there is no significant beam attenuation due to collisions with background gas molecules, as there may be in the vacuum compartment 12*a* with its higher pressure. In addition, the lower pressure helps keep the etching target 22 free of oil and corrosion by-products.

Examples of suitable vacuum pumps are large-capacity Varian (Lexington, Mass.) diffusion pumps. These pumps should not be filled with hydrocarbon, polyether, or silicone oils because of their chemical destruction by the fluorine. Optimum oil lifetime is obtained by using fully-fluorinated Fomblin® oils, available from Lesker (Clairton, Pa.). However, these oils decrease the pumping speed of diffusion pumps by about 50–60%, leaving two Varian pumps, nominally rated at 8000 liters/sec each, with a combined speed of about 7000 liters/sec. Oil-free clean vacuum pumping requires the use of turbo-pumps, which are resistant to fluorine, but at greatly increased cost.

The diffusion pumps' exhaust must be directed to a second stage of compression before being exhausted at atmospheric pressure. Due to the high gas load, optimum performance is obtained by using a roots pump—rotary vane pump combination, available from Balzers (Hudson, N.H.), though a large rotary pump is sufficient by itself. These pumps should also not contain hydrocarbon, chlorinated or polyether oils, and optimum oil performance is obtained by using fully-fluorinated Krytox® or Fomblin® oils, available from DuPont (Wilmington, Del.) or from Lesker (Clairton, Pa.).

Fluorine atoms in the gas jet 20 downstream of the collimator 100 move independently and travel in straight lines emanating from the nozzle opening 36. After emerging past the skimmer 100 into the etching compartment 12*b*, the atomic fluorine beam 20 may be blocked, if desired, by a thin strip of stainless steel or nickel foil inserted into the beam path as a beam flag 112, and whose operation is directed from outside the etching compartment 12*b*. In this manner, the atomic fluorine beam 20 may be regulated, for example preventing it from reaching the etching target 22, or allowing careful control of etching exposure time. The etching target 22 in one embodiment consists of a disc onto which are mounted a plurality of individual targets of diameters 2–25 mm. Each individual target (not shown) can be exposed to the atomic fluorine beam 20 by rotation into the beam path from outside the etching compartment 12*b*. The individual targets are mounted onto a disc made of nickel, inconel, monel, stainless steel or nickel-plated copper for corrosion resistance, and are heated up to about 700° C. from the side opposite the incident atomic fluorine beam 20. Higher temperatures of up to 900° C. may be used when etching particularly resistant materials, or when very rapid etching rates are required. The etching pattern is dictated by a mask 114 which is placed between the etching target 22 and the atomic fluorine beam 20. For high-temperature etching above 400° C., the mask 114 is preferably made of nickel or corrosion-resistant alloys of nickel. Suitable masking may also be provided by the Group II fluorides, lanthanide fluorides (elements 57–71), aluminum fluoride, cadmium fluoride, sodium fluoride, sodium aluminum fluoride or any other fluoride able to withstand the temperatures to which the etching target may be heated in accordance with the use of the present invention.

The atomic fluorine beam size and intensity can be controlled by varying the skimmer size and the distance from the source to the target. Alternatively, if the target may be exposed to the higher pressures in the atomic source chamber, the highest intensities and largest beam size may be achieved by enlarging the skimmer orifice or removing the skimmer altogether.

At temperatures of 1100° to 1150° C. and total gas pressures inside the crystalline tube of 1 to 5 atm of 5% fluorine in helium, the dissociation of molecular fluorine into atomic fluorine exceeds 80%. Typical atomic fluorine beam intensities can then be estimated (absolute beam intensity measurements are prone to inaccuracies exceeding a factor of ten), starting with a total gas flow of 0.5 standard liters per minute, of 5% molecular fluorine diluted in 95% helium, corresponding to a gas flow of $2\times10^{21}$ atoms into the beam source chamber per second. Of this amount, almost 10% is atomic fluorine, but this proportion is enriched about 5-fold by gas—gas collisions within the beam as it emerges from the crystalline tube's nozzle. Beam-background collisions in the relatively high pressure environment of the source chamber causes the loss of about 50% of the beam before reaching the skimmer, which itself has a transmission of about 1%. The beam emerging through the skimmer and into the etching chamber therefore corresponds to a gas flow of approximately $5\times10^{18}$ fluorine atoms per second. For a typical distance from the crystalline tube to the etching target of 3–4 inches, a 1 mm-diameter skimmer produces an atomic beam having a diameter of 3–5 mm at the etching target. The flux of atomic fluorine is therefore estimated to be about $4\times10^{19}$ atoms/cm$^2$-sec, corresponding to a number density of $10^{14}$ atoms/cm$^3$ and a partial pressure of 0.01 torr. This atomic flux is a factor of about 1000 times more intense than available in conventional atomic fluorine beam sources used in surface etching, and could allow etching rates of up to 100 microns per minute (Winters, H. and Coburn, J., "Surface Science Aspects of Etching Reactions", *Surface Science Reports*, North Holland, 14(1992) 161–269).

Etching rates can be controlled by altering the atomic beam intensity, by controlling the etching target temperature, and by blocking the atomic fluorine beam. Beam intensity can be reduced by lowering the beam source temperature or gas flow. The intensity of the effect of the jet or beam on the etching target may be moderated by adjusting the distance of the etching target from the nozzle opening 36.

The purity, intensity, and kinetic energy of the gas jet 20 may be examined by the techniques of "time-of-flight modulation" coupled with "mass spectroscopy" both of which are known to those of ordinary skill in the art. When desired, such measurements may be made by moving the etching target 22 and mask 114 out of the path of the atomic fluorine jet 20, which may be accomplished by manipulation from outside the etching compartment 12*b*. A narrow slit in the circumference of a rotating disc (not shown), placed in the path of the beam 20 rotating at 200 Hz, allows only a short burst (e.g., 20 μsec) of the beam gas to travel to a mass spectrometer, which is able to distinguish between the atomic fluorine, molecular fluorine, and diluent gas species present in the atomic beam 20. As a fast detector, the mass spectrometer is used to measure the time required for fluorine atoms to travel from the rotating disc to the mass spectrometer detector. Knowledge of the distance traveled allows calculation of the atomic fluorine velocity and consequently its kinetic energy. Since the mass spectrometer can also distinguish between atomic and molecular fluorine, it is also used to measure the proportion of molecular fluorine that has been dissociated into atomic fluorine.

Shown in FIG. 7 is an enlargement of a portion of FIG. 3, indicating in more detail how the junction of the inlet end 26 of the tube 24 and the flange 98 is sealed. The inlet end 26 of the tube 24 is seated within the flange housing 58 which is welded to the flange 98. A split ring assembly 120 is seated in the sealing groove 42 of the tube 24. A slip spacer 122 is positioned adjacent the split ring assembly 120 on the distal side. A slip washer 124 is positioned adjacent the split ring assembly 120 on the proximal side, and distal to the compression seal 62. The compression seal 62 is positioned between the slip washer 124 and a shelf 126 within the flange housing 58. As the threaded tube 64 is screwed onto the outwardly extending threaded end of the flange housing, the butting end 65 of the threaded tube 64 forces the slip spacer 122 into the split ring assembly 120, which in turn forces the slip washer 124 into the compression seal 62, in turn forcing the compression seal 62 against the tube 24 and against the housing shelf 126 thereby effecting a gas-tight seal between the tube 24 and the flange housing 58. The compression seal 62 may require cooling, and this can be accomplished by passing cooling water into the cooling system 66, which is comprised of an orifice 66*a* which feeds water into a cooling channel 66*b*. Water exits through an opposite orifice 66*c*.

The gas jet assembly 10 is shown herein as immobile within the vacuum chamber 12. It will be appreciated however that in alternate versions of the invention, it may be desired that the gas jet assembly 10 be constructed such that the structure is movable within the chamber wherein the direction of the atomic fluorine beam 20 can be altered either before, after, or during operation.

FABRICATION METHODOLOGIES

The following describes fabrication methodologies for several of the components described here. It will be appreciated that the techniques described herein only exemplify methods which can be used to fabricate such components and that numerous variations can be envisioned for fabricating such components and that the scope of the claimed invention should not be limited by those specific fabrication techniques described herein. It will also be noted that the trade names of items and equipment used anywhere herein are only exemplary of such materials suitable for use herein and that the claimed invention is not limited to the specific sources listed herein.

Crystalline Tube

A boule of high-purity magnesium fluoride (preferably at least 99.9% purity), available from Optovac (North Brookfield, Mass.) in "mosaic" or "optical" grades, is machined using the following equipment: a precision drill press with spindle speed of at least 1800 rpm; a precision lathe with spindle speed of at least 10,000 rpm and a three-eighth inch collett adapter; a precision tool grinder with O.D. grinding fixture and three-eighth inch collett adapter; a three-eighth inch I.D. diamond core drill with six inch depth of cut, available from Continental Diamond Tool (New Haven, Ind.); a three-sixteenth inch O.D. diamond disintegrating core drill with six inch depth of cut, available from Continental Diamond Tool (New Haven, Ind.); a coolant feed drill head assembly for core drills, available from Continental Diamond Tool (New Haven, Ind.); a 2 mm-diameter micrograin carbide drill with six inch shank, available from National Jet (Lavale, Md.); a 0.006 inch-diameter micrograin carbide drill, available from National Jet (Lavale, Md.); a diamond grinding wheel (150 grt×¼"×6"), available from Continental Diamond Tool (New Haven, Ind.); a 20× microscope, available from Edmund Scientific (Barrington, N.J.); and a fiber optic light source, available from Edmund Scientific (Barrington, N.J.).

The magnesium fluoride boule is first protected by waxing it into a metal tube whose internal diameter is roughly 0.020 inches larger than the outside diameter of the boule. After this is accomplished the boule may easily be held by conventional clamping apparatus. The standard boule of 1¾ inches diameter×5½ inches long yields eight tubes. The boule is cored with the three-eighth inch I.D. core drill at a rate of approximately 0.001 inches per revolution at 1800 rpm. The boule should be backed up with a piece of glass to minimize "break out" damage.

The cores are ground square at each end with the diamond wheel. They are then placed in the high-speed precision lathe and bored five inches deep with the three-sixteenth inch disintegrating core drill at a rate of 0.0005 inches per revolution at 2000 rpm. The tubes are then drilled from the opposite end with the 0.006 inches-diameter drill to a depth of 0.020 inches. This operation requires the operator to use a 20× microscope with a good light source to be able to observe the drill entering the material properly, i.e., the drill must be precisely centered to achieve dimensional precision and to avoid breaking the drill. The operator must take great care to ensure that the drill is properly lubricated and that the chips are being cleared away. A mist coolant device is ideal for meeting these criteria. The operator must peck the drill into the material at a rate of no more than 0.001–0.002 inches per step at 10,000 rpm. Note that there is no through hole at this time.

The tubes are then reloaded into the lathe so that the 2 mm drill may be inserted down the center of the existing three-sixteenth inch hole. At this time it is helpful to hold the tube in an optically transparent fixture so that the operator can observe that the 2 mm drill is properly centered when it enters the material at the bottom of the hole. It is important to lubricate the drill and wash the chips clear of the 2 mm hole. The operator must carefully feed the 2 mm drill into the material until it intersects the 0.006 inch hole. Care must be taken to back up the face of the tube opposite the 2 mm hole being drilled to avoid stressing the area around the 0.006 inch hole and causing breakout damage, thereby destroying the tube.

To facilitate heating and mechanically retaining the tube, two journals are ground on the tube. The first is on the nozzle end, and is 0.250" O.D.×0.250" long. The second is ground with the leading shoulder 4.125 inches from the nozzle end and is 0.300" O.D.×0.250" long.

Tantalum Heater

A square inch of 0.005 inch-thick tantalum sheet and six inches of #10 gauge tantalum wire in the annealed condition is machined using the equipment: a 0.375 inch-diameter drawing die; a 0.365 inch-diameter drawing punch; a drill press; a spot welder with precision timing control; a bottle of argon gas.

A five-eighth inch-diameter disc is cut out of the 0.005 inch tantalum material. The 0.365 inch punch is placed in the drill press chuck. The 0.375 inch die is centered beneath the punch such that when punch is inserted into the die the annular clearance is 0.005 inches. The die is clamped in place. The die is lubricated with an aerosol Teflon coating. The tantalum disc is placed in the center of the drawing die. (It is advantageous to have a shallow counter-bore in the die to accomplish proper centering of the disc.) The punch is swiftly rammed into the disc through the die thus drawing the disc into a cup. With the cup still drawn over the punch, release the punch from the drill chuck and unclamp the die. Let the punch pass through the die completely in one direction. After the punch is removed from the drill press with the tantalum cup still drawn over the end, place the punch in a lathe using the punch as a mandrel for the cup, and trim the sides of the cup such that the overall height of the cup is 0.100–0.120 inches. With a very sharp tool, trepan the bottom of the cup to a diameter of 0.280 inches. The tantalum heater filament is removed from the mandrel.

Cut a two inch-length of wire from the #10 gauge stock. Crush the tip of this two inch section around a three-eighth inch mandrel. (A hard steel dowel pin works well for a mandrel.) The crushed section should be roughly 0.10 inches long, 0.020 inches thick, and fit closely to the outside of the heater filament. Spot-weld this section of wire to the heater filament (1000 A for 60 msec). Care must be taken to shield the area being welded with argon gas to avoid embrittlement of the weldment. Repeat this procedure for the second heater lead. After both leads are securely welded to the filament, bend them carefully to fit into the copper electrodes.

Hemispherical Radiation Shielding

A 2"×4"×0.005"-thick tantalum sheet and a 2"×4"×0.005"-thick nickel sheet is machined using standard tooling suitable for the construction of draw-forming dies.

Four dies are constructed to produce four concentric hemispherical hat-sections having the following radius and material specifications: 0.375 inch tantalum, 0.400 inch tantalum, 0.425 inch nickel, 0.450 inch nickel. Note that, after forming, these hemispherical sections must be relieved to accommodate the crystalline tube, the heater leads, and the thermocouples. The rim of the hat should be trimmed to a diameter of 0.975 inches on each hemispherical section. The sections are then stacked concentrically to form three annular radial cavities of approximately 0.025 inch. This assembly is then placed in a cylinder one inch in diameter, 0.3 inches long, with an inside diameter of 0.910 inches and counter-bored 0.978 inch I.D.×0.10" deep (the hemispherical assembly is placed into the counter-bored cavity). The 0.011"×0.10" rim of the cylinder is then formed over and around the edges of the shield stack to hold them securely.

Changes may be made in the construction and the operation of the various components, elements and assemblies described herein or in the steps or the sequence of steps of the methods described herein without departing from the spirit and scope of the invention as defined in the following claims.

What is claimed is:

1. An apparatus for producing a fluorine jet or beam, comprising:

a hollow crystalline tube for receiving a pressurized fluorine gas, the tube having an inlet end and an outlet end and constructed from a fluoride crystal; and heating means localized near a terminal portion of the crystalline tube and able to heat the terminal portion to a temperature sufficient to cause dissociation of the pressurized fluorine gas within the crystalline tube near the terminal portion into atomic fluorine and emission therefrom as a jet or beam comprising atomic fluorine.

2. The apparatus of claim 1 wherein the crystalline tube is constructed from a crystal selected from the group consisting of magnesium fluoride, calcium fluoride, strontium fluoride and barium fluoride.

3. The apparatus of claim 1 wherein the heating means further comprises a heating collar constructed from a highly refractory material and an insulating collar constructed from an electrically insulating material, wherein the insulating collar is disposed about the outer surface of the terminal end of the tube and the heating collar is disposed adjacent an outer portion of the insulating collar.

4. The apparatus of claim 3 wherein the heating collar is comprised of an electrical conductor selected from the group consisting of tantalum, tungsten, molybdenum, rhenium, niobium, iridium, graphite and silicon carbide.

5. The apparatus of claim 1 further comprising shielding means disposed about a portion of the crystalline tube for protecting the heating means from corrosion by fluorine atoms from the atomic fluorine jet.

6. The apparatus of claim 1 further comprising heat reflecting means disposed proximal to the heating means for reflecting heat generated by the heating means in a direction toward the heating means.

7. The apparatus of claim 1 further comprising thermocouple means for measuring the temperature of the heating means.

8. The apparatus of claim 1 further comprising sealing means for sealing the inlet end of the tube within a portal to a fluorine gas supply.

9. The apparatus of claim 1 further comprising a vacuum chamber adapted to contain at least a portion of the crystalline tube.

10. The apparatus of claim 9 wherein the vacuum chamber has disposed therein means for collimating the fluorine jet into a substantially unidirectional beam.

11. The apparatus of claim 1 wherein the outlet end of the tube has a nozzle opening having a diameter in a range of from 0.002 inches to 0.040 inches.

12. An apparatus for producing a fluorine jet or beam, comprising a hollow crystalline tube for receiving a pressurized fluorine gas, the tube having an inlet end and an outlet end and constructed from a crystal which has a melting point higher than 800° C. and which has a corrosion rate of less than 100 nm/min when a fluorine gas is passed therethrough when the outlet end is heated to a temperature higher than 800° C.

13. The apparatus of claim 12 wherein the crystalline tube is constructed from a crystal selected from the group comprising magnesium fluoride, calcium fluoride, strontium fluoride, barium fluoride and combinations thereof.

14. The apparatus of claim 12 further comprising heating means able to heat a terminal portion of the crystalline tube near the outlet end to a temperature sufficient to cause dissociation of the pressurized fluorine gas within the crystalline tube near the outlet end into atomic fluorine and emission therefrom as a jet comprising atomic fluorine.

15. A method for producing a fluorine jet, comprising:

providing an apparatus comprising a hollow crystalline tube for receiving a pressurized fluorine gas, the tube having an inlet end and an outlet end and constructed from a fluoride crystal;

heating the terminal portion of the crystalline tube to a temperature within the range of from about 20° C. to about 10° C. below the melting point of the crystal; and introducing a pressurized fluorine gas mixture into the crystalline tube wherein a jet of fluorine is emitted from the terminal end of the crystalline tube.

16. The method of claim 15 wherein in the step of providing the apparatus, the crystalline tube is constructed from a crystal selected from the group comprising magnesium fluoride, calcium fluoride, strontium fluoride and barium fluoride.

17. The method of claim 15 wherein in the step of providing the apparatus, the crystalline tube is constructed from a crystal which has a melting point higher than 800° C. and which has a corrosion rate of less than 100 nm/min when a fluorine gas is passed therethrough when the outlet end is heated to a temperature higher than 800° C.

18. The method of claim 15 wherein in the step of providing the apparatus, the apparatus further comprises heating means localized near a terminal portion of the crystalline tube and able to heat the terminal portion to a temperature of at least about 800° C.

19. The method of claim 15 wherein in the step of providing the apparatus, at least a portion of the crystalline tube is disposed within a vacuum chamber for operating the apparatus at a negative pressure.

20. The method of claim 15 wherein in the step of introducing the fluorine gas mixture the mixture comprises a gas selected from the group comprising helium, neon, nitrogen, argon, krypton, xenon, or any suitable mixture thereof.

21. The method of claim 15 wherein in the step of introducing a pressurized fluorine gas mixture, the gas mixture is under a pressure of at least 0.1 atm.

22. The method of claim 15 wherein in the step of heating the terminal portion of the tube, the temperature is in a range of from about 1000° C. to within about 10° C. of the melting point of the tube.

23. The method of claim 15 wherein in the step of introducing the fluorine gas mixture, the jet of fluorine achieves a kinetic energy of up to about 1.6 eV when the fluorine is atomic and up to about 3.2 eV when the fluorine is molecular.

24. A method of etching a surface, comprising:

providing an apparatus comprising a hollow crystalline tube for receiving a pressurized fluorine gas, the tube having an inlet end and an outlet end and constructed from a fluoride crystal, and wherein at least the terminal portion of the crystalline tube is disposed within a vacuum chamber under a negative pressure;

providing an etching target, the etching target within the vacuum chamber;

heating the terminal portion of the crystalline tube to a temperature within the range of from about 20° C. to about 10° C. below the melting point of the crystal;

introducing a pressurized fluorine gas mixture into the crystalline tube wherein a jet of fluorine is emitted from the terminal end of the crystalline tube; and directing the fluorine jet at the etching target whereby a surface of the etching target is impacted by at least a portion of the fluorine jet.

25. The method of claim 24 wherein in the step of providing the apparatus, the crystalline tube is constructed from a crystal selected from the group comprising magnesium fluoride, calcium fluoride, strontium fluoride, barium fluoride and the Lanthanide fluorides (elements 57–71).

26. The method of claim 24 wherein in the step of providing the apparatus, the crystalline tube is constructed from a crystal which has a melting point higher than 800° C. and which has a corrosion rate of less than 100 nm/min when a fluorine gas is passed therethrough when the outlet end is heated to a temperature higher than 800° C.

27. The method of claim 24 wherein in the step of providing the apparatus, the apparatus further comprises heating means comprising a heating collar constructed from a highly refractory material and an electrically insulating collar constructed from an insulating material, wherein the insulating collar is disposed about the outer surface of the terminal end of the tube and the heating collar is disposed adjacent an outer portion of the insulating collar.

28. The method of claim 24 wherein in the step of providing the etching target, the etching target is disposed within a second vacuum chamber under a second negative pressure more negative than the first negative pressure.

29. The method of claim 24 wherein in the step of directing the fluorine jet, before the jet impacts the etching target, the jet is passed through means for collimating the fluorine jet into a substantially unidirectional beam.

30. The method of claim 24 wherein in the step of providing the etching target the etching target has a masking material constructed from a group comprising magnesium fluoride, calcium fluoride, strontium fluoride and barium fluoride, and the lanthanide fluorides.

31. The method of claim 24 wherein the step of directing the fluorine jet further comprises moderating the intensity of the effect of the jet on the etching target by adjusting the position of the etching target in relation to the outlet end of the tube.

32. The method of claim 24 wherein in the step of introducing a pressurized fluorine gas mixture, the jet of fluorine gas which is emitted has a pressure within the jet which exceeds the background pressure by a factor greater than about ten.

33. The method of claim 28 wherein the second vacuum chamber has a pressure of less than about $10^{-4}$ torr.

34. The apparatus of claim 1 wherein the crystalline tube is constructed from a crystal comprising a lanthanide fluoride.

35. The apparatus of claim 12 wherein the crystalline tube is constructed from a crystal comprising a lanthanide fluoride.

36. A method for producing a fluorine jet, comprising:

providing an apparatus comprising a hollow crystalline tube having an inlet end and an outlet end and constructed from a fluoride crystal;

heating the terminal portion of the crystalline tube; and introducing a pressurized fluorine gas mixture into the crystalline tube wherein a jet of fluorine is emitted from the terminal end of the crystalline tube.

37. The method of claim 36 wherein in the step of providing the apparatus, the crystalline tube is constructed from a fluoride crystal selected from the group comprising magnesium fluoride, calcium fluoride, strontium fluoride, barium fluoride, the lanthanide fluorides, and combinations thereof.

38. A method of etching a surface, comprising:

providing an apparatus comprising a hollow crystalline tube for receiving a pressurized fluorine gas, the tube having an inlet end and an outlet end and constructed from a fluoride crystal, and wherein at least the terminal portion of the crystalline tube is disposed within a vacuum chamber;

providing an etching target, the etching target within the vacuum chamber;

heating the terminal portion of the crystalline tube;

introducing a pressurized fluorine gas mixture into the crystalline tube wherein a jet of fluorine is emitted from the terminal end of the crystalline tube; and directing the fluorine jet at the etching target whereby a surface of the etching target is impacted by at least a portion of the fluorine jet.

39. The method of claim 38 wherein in the step of providing the apparatus, the crystalline tube is constructed from a fluoride crystal selected from the group comprising magnesium fluoride, calcium fluoride, strontium fluoride, barium fluoride, the lanthanide fluorides, and combinations thereof.

* * * * *